US008839748B2

(12) United States Patent
Kim et al.

(10) Patent No.: US 8,839,748 B2
(45) Date of Patent: Sep. 23, 2014

(54) HEAT EXCHANGER FOR VEHICLE

(71) Applicant: Hyundai Motor Company, Seoul (KR)

(72) Inventors: Jae Yeon Kim, Hwaseong-si (KR); Wan Je Cho, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 13/706,033

(22) Filed: Dec. 5, 2012

(65) Prior Publication Data

US 2013/0327287 A1 Dec. 12, 2013

(30) Foreign Application Priority Data

Jun. 11, 2012 (KR) ..... 10-2012-0062266

(51) Int. Cl.

| | |
|---|---|
| ***F01P 11/08*** | (2006.01) |
| ***F28F 27/02*** | (2006.01) |
| ***F01P 7/16*** | (2006.01) |
| ***F28D 9/00*** | (2006.01) |
| *F28D 21/00* | (2006.01) |

(52) U.S. Cl.

CPC ..... *F01P 7/16* (2013.01); *F01P 2060/08* (2013.01); *F28F 27/02* (2013.01); *F01P 11/08* (2013.01); *F01P 2060/045* (2013.01); *F28F 2250/06* (2013.01); *F28D 2021/0089* (2013.01); *F28D 9/005* (2013.01)

USPC ..... 123/41.33; 165/166; 165/103; 165/167; 165/296; 165/297

(58) Field of Classification Search

CPC ..... F28F 3/02; F28D 1/0333; F28D 9/005; F28D 20/0034

USPC ..... 123/41.33; 165/296, 297, 166, 66, 11.1, 165/170

See application file for complete search history.

(56) References Cited

U.S. PATENT DOCUMENTS

| | | | | |
|---|---|---|---|---|
| 3,506,192 | A * | 4/1970 | Otto | 236/34.5 |
| 4,375,753 | A | 3/1983 | Imasu et al. | |

(Continued)

FOREIGN PATENT DOCUMENTS

| | | | |
|---|---|---|---|
| JP | 10-157445 | A | 6/1998 |
| JP | 2001508163 | A | 6/2001 |
| JP | 2001-233036 | A | 8/2001 |
| KR | 1020100060638 | A | 6/2010 |

*Primary Examiner* — Noah Kamen
*Assistant Examiner* — Long T Tran
(74) *Attorney, Agent, or Firm* — Morgan, Lewis & Bockius LLP

(57) ABSTRACT

A heat exchanger for a vehicle includes: a heat releasing unit that is stacked with a plurality of plates and that forms connection flow channels to intersect at the inside thereof to inject other working fluids and that exchanges a heat of working fluids that pass through the respective connection flow channels, a bypass unit that is formed in the heat releasing unit to form a plurality of inflow holes and exhaust holes that inject and exhaust the working fluids to the respective connection flow channels and that connects the inflow hole and the exhaust hole that is connected to one of the respective connection flow channels, and a valve unit that is mounted within the heat releasing unit to correspond to the inflow hole that forms the bypass unit and that is selectively opened or closed using a deformation force of bimetal that is deformed according to a temperature of a working fluid that is injected into the inside thereof to inject the working fluid into the heat releasing unit and the bypass unit.

17 Claims, 10 Drawing Sheets

(56) References Cited

U.S. PATENT DOCUMENTS

| | | | | |
|---|---|---|---|---|
| 4,669,532 | A | 6/1987 | Tejima et al. | |
| 6,182,749 | B1 * | 2/2001 | Brost et al. | 165/297 |
| 6,814,133 | B2 * | 11/2004 | Yamaguchi | 165/41 |
| 7,243,707 | B2 * | 7/2007 | Brost et al. | 165/103 |
| 7,735,520 | B2 * | 6/2010 | Peric | 137/855 |
| 8,056,231 | B2 | 11/2011 | Luvisotto et al. | |
| 2006/0032626 | A1 * | 2/2006 | Keen | 165/280 |
| 2006/0237185 | A1 * | 10/2006 | Peric | 165/297 |
| 2008/0104841 | A1 * | 5/2008 | Luvisotto et al. | 29/890.03 |
| 2008/0110595 | A1 * | 5/2008 | Palanchon | 165/103 |
| 2010/0206516 | A1 * | 8/2010 | Muller-Lufft et al. | 165/96 |
| 2011/0180242 | A1 * | 7/2011 | Urata et al. | 165/166 |

* cited by examiner

HEAT EXCHANGER FOR VEHICLE

CROSS-REFERENCE TO RELATED APPLICATION

The present application claims priority to Korean Patent Application No. 10-2012-0062266 filed on Jun. 11, 2012, the entire contents of which is incorporated herein for all purposes by this reference.

BACKGROUND OF THE INVENTION

1. Field of the Invention

The present invention relates to a heat exchanger for a vehicle. More particularly, the present invention relates to a heat exchanger for a vehicle that adjusts a temperature through heat exchange by injecting each working fluid into the inside.

2. Description of Related Art

In general, a heat exchanger transfers a heat from a fluid of a high temperature to a fluid of a low temperature through a conductive wall and is used for a heater, a refrigerator, an evaporator, and a condenser.

The heat exchanger reuses heat energy or adjusts a temperature of a working fluid that is injected to correspond to usage, is applies to an air conditioning system or a transmission oil cooler of a vehicle, and is mounted in an engine compartment.

Here, when the heat exchanger is mounted in an engine compartment having limited space, the heat exchanger has difficulty in securing space and in mounting and thus a research for a small size, a light weight, high efficiency, and a high function has been continued.

However, the conventional heat exchanger should adjust a temperature of each working fluid according to a state of a vehicle and supply a working fluid to an engine or a transmission, and an air conditioning apparatus of the vehicle, but for this purpose, the conventional heat exchanger should install a separate branch circuit and valve on a flow channel of the injected working fluid, and thus there is a problem that the number of constituent elements and assembly operations increase and layout becomes complicated.

Further, when a separate branch circuit and valve are not installed, there is a problem that a heat exchange amount cannot be controlled according to a flux of the working fluid and thus efficient temperature adjustment of the working fluid is impossible.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a heat exchanger for a vehicle having advantages of simultaneously performing a warm-up function and a cooling function of a working fluid according to a temperature of the injected working fluid according to a running state or an initial starting condition of the vehicle when each working fluid adjusts a temperature through heat exchange at the inside.

The present invention has been made in an effort to further provide a heat exchanger for a vehicle having advantages of improving fuel consumption and a heating performance of the vehicle by adjusting a temperature of a working fluid according to a state of the vehicle and reducing the number of assembly operations by simplifying a configuration.

In an aspect of the present invention, a heat exchanger apparatus for a vehicle, may include a heat releasing unit that is stacked with plates and that may have first and second connection flow channels at the inside thereof to inject working fluids and that exchanges a heat of the working fluids that pass through the first and second connection flow channels, a bypass unit that connects an inflow hole and an exhaust hole that are formed in the heat releasing unit, wherein the inflow hole and the exhaust hole are connected to the first and second connection flow channels, respectively and wherein the bypass unit selectively bypasses an injected working fluid therethrough, and a valve unit that is selectively open or closed using a deformation member that is deformed according to a temperature of a working fluid that is injected into the inside thereof to inject the working fluid into the heat releasing unit and the bypass unit.

The inflow hole may include first and second inflow holes that are each formed at both sides thereof in a length direction of the heat releasing unit, wherein the exhaust hole is separated from the first and second inflow holes at both sides, in a length direction of the heat releasing unit and may include first and second exhaust holes that are connected to respective connection flow channel at the inside of the heat releasing unit.

The valve unit may include a deformation member deformable according to a temperature of the working fluid, an inner case having a first bypass hole and a first opening hole, and an outer case enclosing the inner case and rotatably supporting the inner case, wherein the outer case may include a second bypass hole and a second opening hole that are selectively fluid-connected to the first bypass hole and the first opening hole according to the inner case rotated by the deformation member.

A fixing member that may have a mounting groove at the center of an upper surface and that is fixedly mounted in the heat releasing unit to correspond to the first inflow hole, a rod having a lower end portion that is inserted into the mounting groove of the fixing member and that is rotatably mounted thereto, a mounting cap having an insertion hole at the center in order to receive the rod therethrough and that is mounted in the fixing member, the deformation member that is mounted in the rod in an upper part of the mounting cap and that rotates the rod in a forward direction or a backward direction according to the temperature of the working fluid, the inner case that is fixed to a front end of the rod in an upper part of the fixing member to rotate together with the rod and that may have the first bypass hole in the upper part, and that may have the first opening hole that is separated from the first bypass hole, and the outer case that rotatably supports the inner case in a state that encloses the outside of the inner case and that may have the second bypass hole and the second opening hole that are selectively connected to the first bypass hole and the first opening hole according to the rotation of the inner case and that is fixed to the fixing member, and wherein the deformation member is made of a bimetal material that contracts and expands according to the temperature of the working fluid.

The deformation member is formed in a spiral whirlpool shape, and one end that is positioned at the center thereof is bent to be fixed to the rod in a state that penetrates through a lower portion of the rod, and the other end thereof is bent to the outside of the deformation member to be supported by the inside of the outer case.

In the outer case, a latch protrusion is protruded toward the inside thereof so that the other end of the deformation member is fixed in a state that is supported at one side of an interior circumference to correspond to the other end of the deformation member.

The inner case is fixed to the rod through a fixing pin that is inserted into the side of the rod in an upper end portion.

The inner case may have a penetration hole at an upper surface thereof in order to inject a working fluid that is injected into the first inflow hole into the valve unit.

A plurality of penetration holes are separated by a setting angle in a circumferential direction at an upper surface of the inner case, and three penetration holes are formed.

The inner case is formed in a cylindrical shape having an opened lower end portion.

The first bypass hole and the first opening hole are separated by a setting angle along a circumference thereof in an upper part and a lower part of the inner case.

The first opening hole is formed in a length direction of the inner case in a lower part that separated from the first bypass hole.

The second bypass hole and the second opening hole are alternately formed at a position that is separated by a setting angle along a circumference thereof in an upper part and a lower part of the outer case to correspond to the first bypass hole and the first opening hole respectively.

The second opening hole is formed in a length direction in a lower part of the outer case at a position alternately with the second bypass hole.

The fixing member is integrally formed with a mounting portion that is protruded by a predetermined portion from an upper portion of an upper surface in which the mounting groove is formed and in which the mounting cap is mounted.

A seal ring that prevents a working fluid from being leaked between the heat releasing unit and the fixing member while preventing a working fluid that is injected into the valve unit from being leaked to the outside of the valve unit is mounted between the fixing member and the outer case.

The outer case is formed in a cylindrical shape having opened both ends.

The bypass unit connects the first inflow hole and the first exhaust hole and is protruded from one side of the heat releasing unit.

The each working fluid is formed with coolant that is injected from a radiator and transmission oil that is injected from an automatic transmission, the coolant circulates through the first inflow hole and the first exhaust hole, and the transmission oil circulates through the second inflow hole and the second exhaust hole, and the each connection flow channel may include a first connection flow channel in which the coolant is injected and moves and a second connection flow channel in which the transmission oil is injected and moves.

The bypass unit may have a separate bypass flow channel separately from the first connection flow channel in order to immediately exhaust coolant that is injected into the first inflow hole to the first exhaust hole through the valve unit at a position adjacent to the first inflow hole and the first exhaust hole.

The heat releasing unit may make flow of each working fluid to counterflow and enable the each working fluid to exchange heat.

The heat releasing unit may be formed in a plate type that is stacked with a plurality of plates.

As described above, in a heat exchanger for a vehicle according to an exemplary embodiment of the present invention, when a working fluid adjusts a temperature through heat exchange at the inside, by simultaneously performing a warm-up function and a cooling function of a working fluid using a temperature of the injected working fluid according to a running state or an initial starting condition of the vehicle, temperature adjustment of the working fluid can be efficiently performed.

Further, because a temperature of a working fluid can be adjusted according to a state of a vehicle, fuel consumption and a heating performance of the vehicle can be improved, and by simplifying a configuration, and the number of assembly operations can be reduced.

Further, because a conventionally separately installed branch circuit can be removed, a production cost can be reduced and workability can be improved, and when a working fluid is automatic transmission oil, a warm-up function for friction reduction upon cold starting and a cooling function for slip prevention and durability maintenance upon traveling can be simultaneously performed and thus fuel consumption and durability of a transmission can be improved.

Further, by selectively flowing a working fluid to a heat releasing unit and a bypass unit according to a temperature of the working fluid that is injected through a valve unit to which a deformation member of a bimetal material is applied, flow of the working fluid can be accurately controlled, and by simplifying a constituent element, compared with a conventional wax expansion type valve, a production cost can be reduced and a weight can be reduced.

Responsiveness of a valve switch operation according to a temperature of a working fluid can be improved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
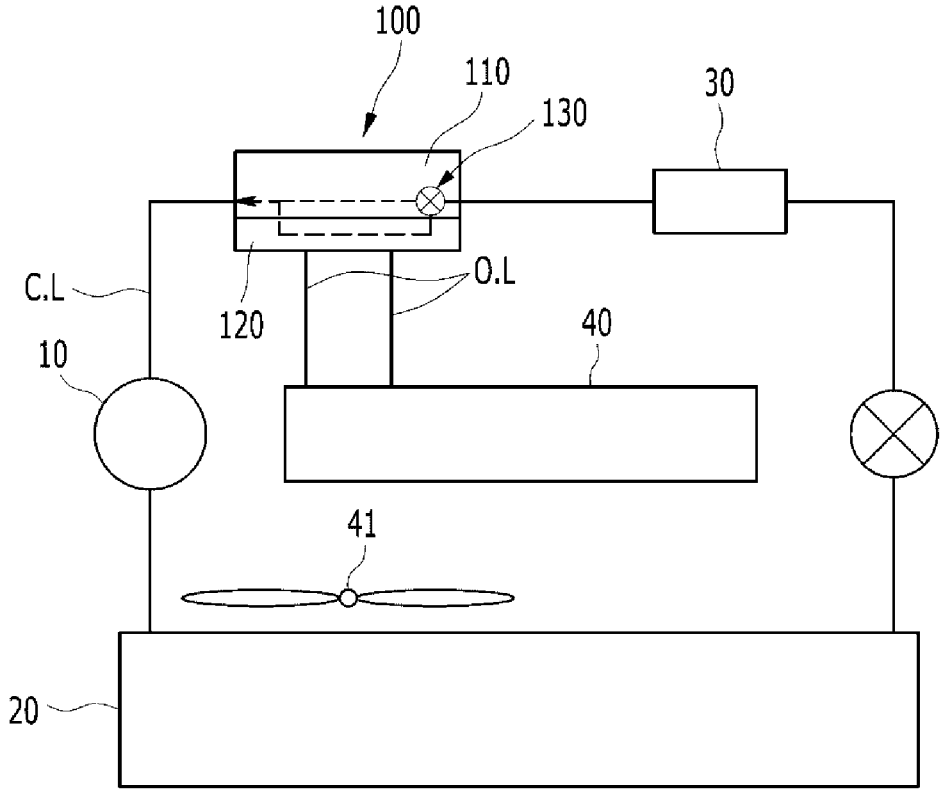
FIG. 1 is a block diagram illustrating a configuration of an automatic transmission cooling system to which a heat exchanger for a vehicle is applied according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Before a description, an exemplary embodiment that is described in this specification and a configuration that is shown in the drawings are only an exemplary embodiment of the present invention and do not represent the entire spirit and scope of the invention and thus it should be understood that various modifications and exemplary variations that can replace the exemplary embodiment and the configuration may exist at an application time point of the present invention.

Figure 2:
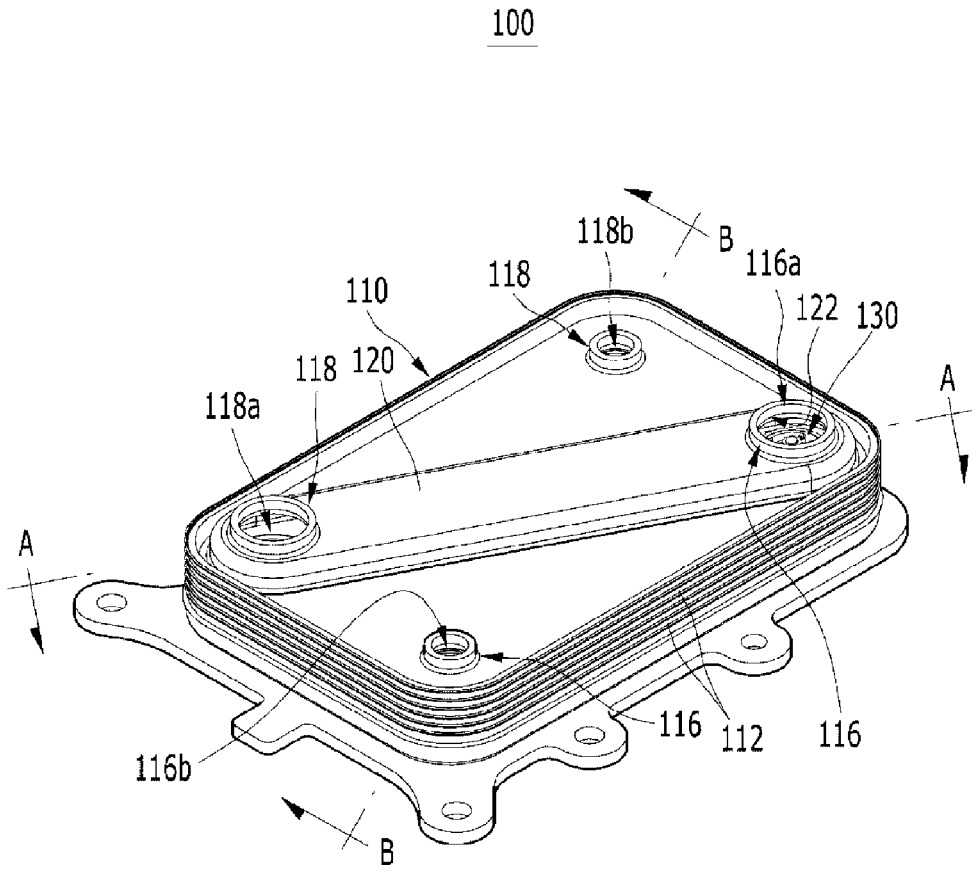
FIG. 2 is a perspective view illustrating a heat exchanger for a vehicle according to an exemplary embodiment of the present invention.
Figure 3:
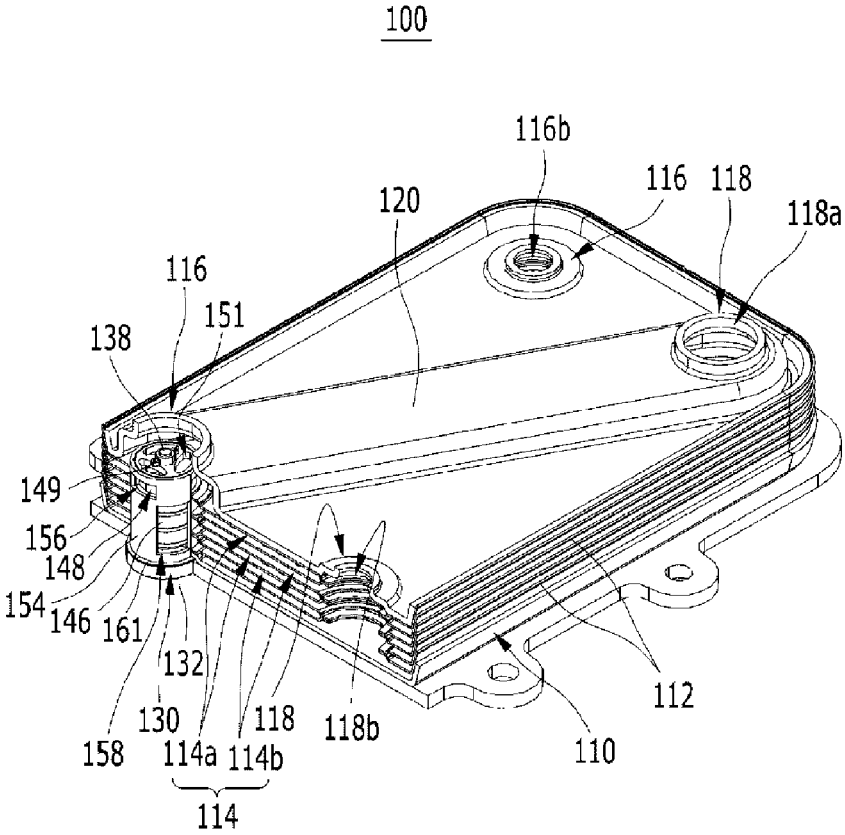
FIG. 3 is a partially cut-away perspective view illustrating a heat exchanger for a vehicle according to an exemplary embodiment of the present invention.
Figure 4:
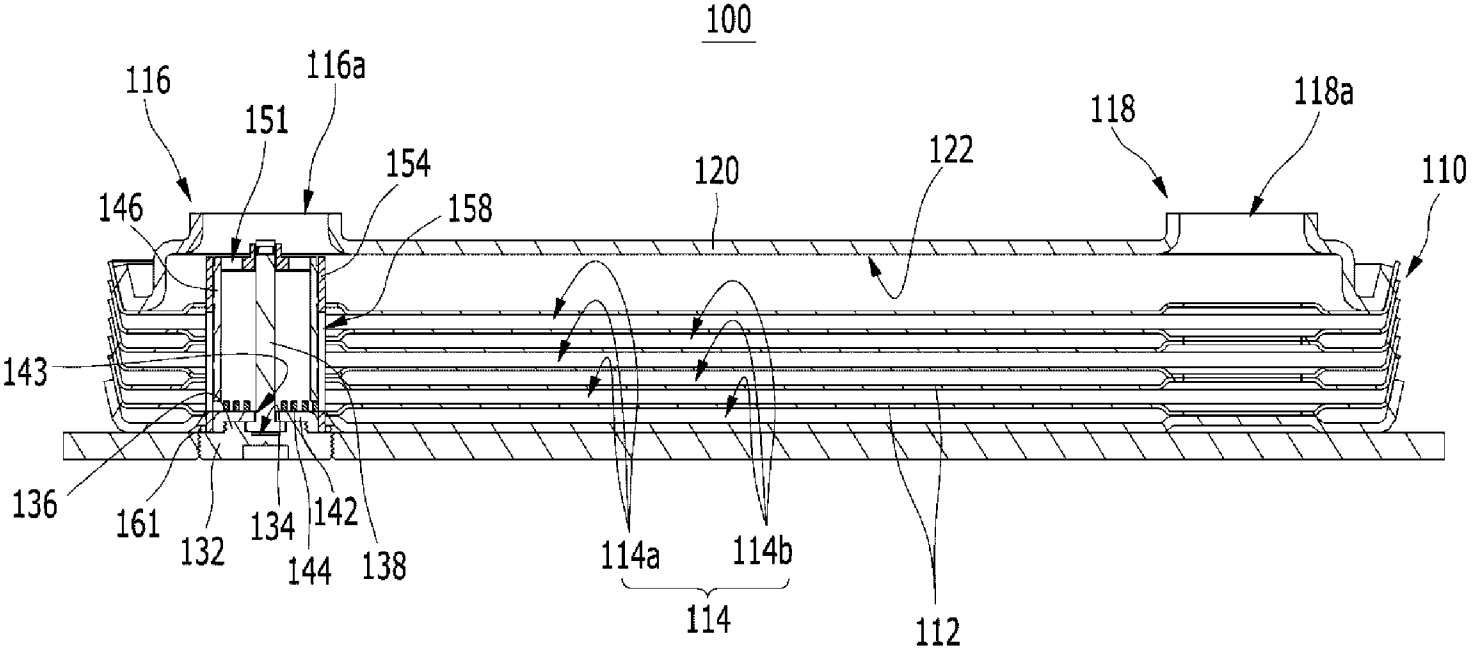
FIG. 4 is a cross-sectional view illustrating the vehicle heat exchanger taken along line A-A of FIG. 2.
Figure 5:
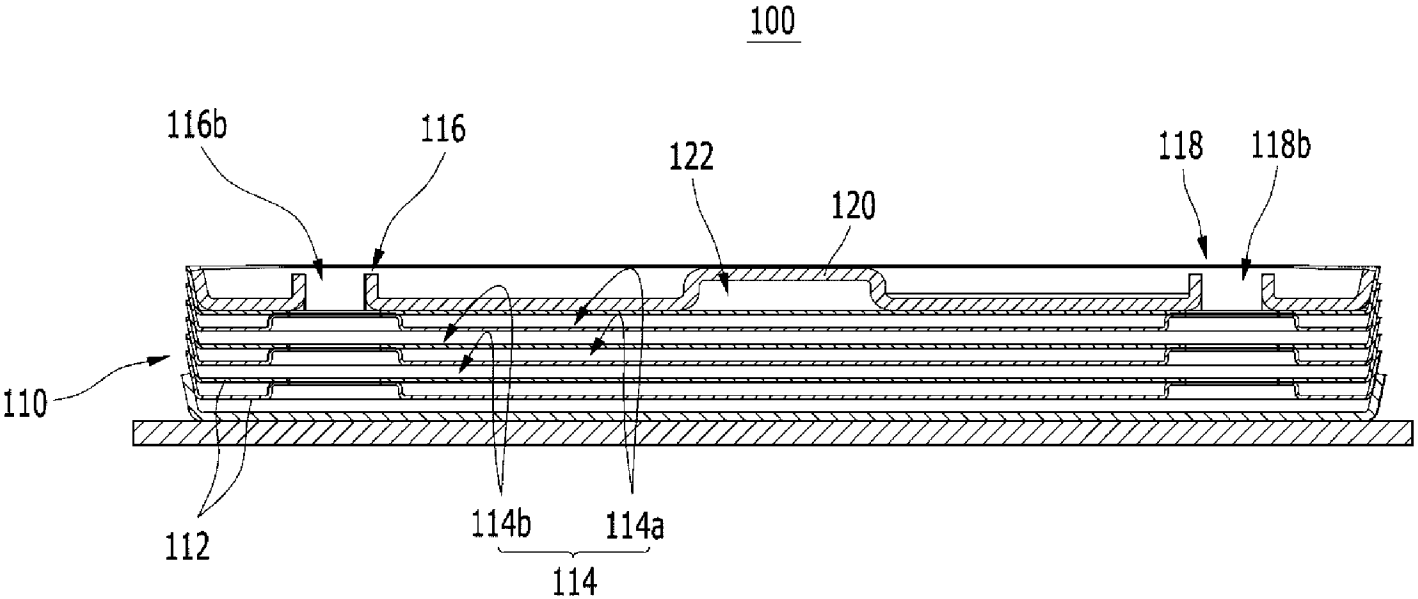
FIG. 5 is a cross-sectional view illustrating the vehicle heat exchanger taken along line B-B of FIG. 2.
Figure 6:
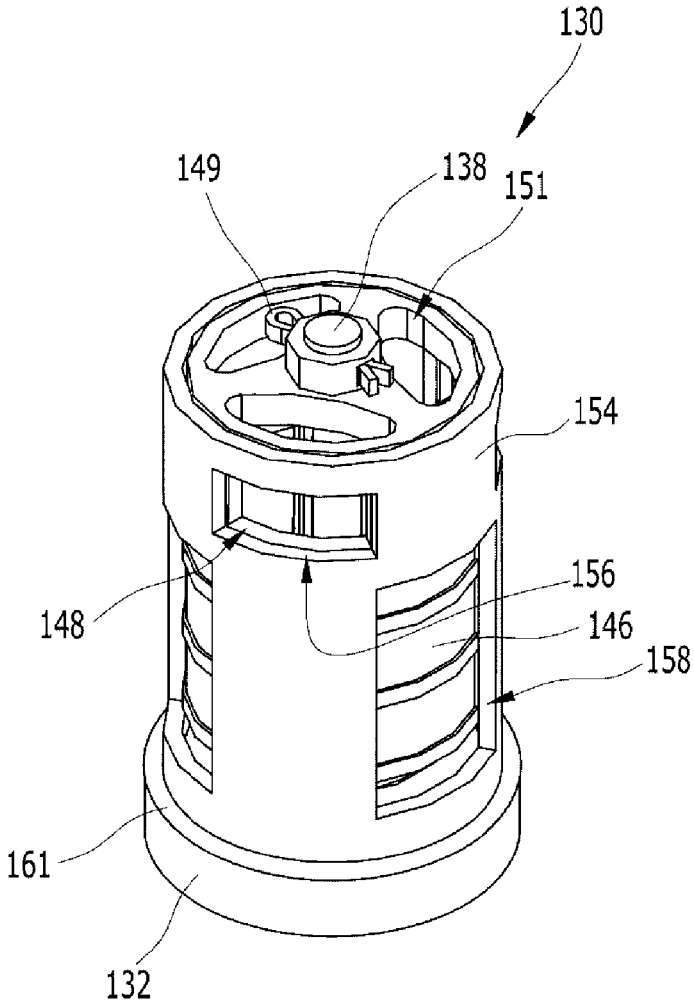
FIG. 6 is a perspective view illustrating a valve unit that is applied to a heat exchanger for a vehicle according to an exemplary embodiment of the present invention.
Figure 7:
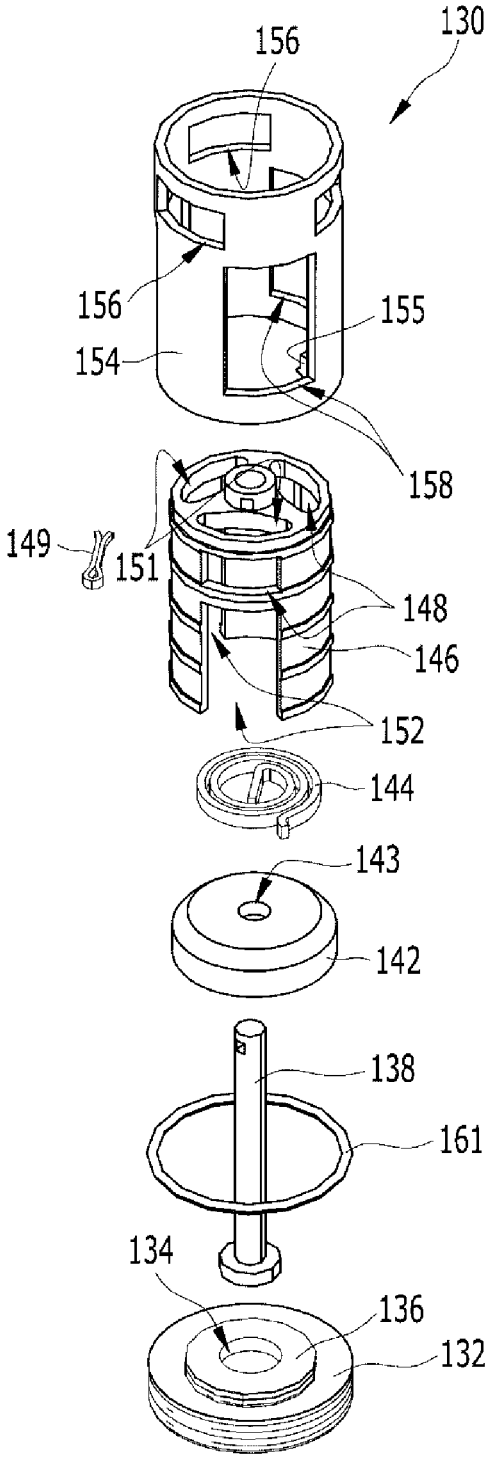
FIG. 7 is an exploded perspective view illustrating a valve unit according to an exemplary embodiment of the present invention.

FIG. 1 is a block diagram illustrating a configuration of an automatic transmission cooling system to which a heat exchanger for a vehicle is applied according to an exemplary embodiment of the present invention, FIGS. 2 and 3 are a perspective view and a partially cut-away perspective illustrating a heat exchanger for a vehicle according to an exemplary embodiment of the present invention, FIG. 4 is a cross-sectional view illustrating the vehicle heat exchanger taken along line A-A of FIG. 2, FIG. 5 is a cross-sectional view illustrating the vehicle heat exchanger taken along line B-B of FIG. 2, and FIGS. 6 and 7 are a perspective view and an exploded perspective view illustrating a valve unit that is applied to a heat exchanger for a vehicle according to an exemplary embodiment of the present invention.

Referring to the drawings, a vehicle heat exchanger 100 according to an exemplary embodiment of the present invention is applied to an automatic transmission cooling system of a vehicle.

As shown in FIG. 1, the automatic transmission cooling system generally includes a cooling line (hereinafter, referred to as 'C.L') in which coolant that is cooled while passing through a radiator 20 in which a cooling fan 41 is mounted cools an engine through a water pump 10 and a heater core 30 that is connected to a vehicle heating system (non shown) on the C.L.

Here, when each working fluid adjusts a temperature through heat exchange at the inside of the vehicle heat exchanger 100, the vehicle heat exchanger 100 according to an exemplary embodiment of the present invention has a structure that can simultaneously perform a warm-up function and a cooling function of the working fluid according to a temperature of the injected working fluid according to a running state or an initial starting condition of a vehicle.

Further, because a temperature of a working fluid can be adjusted according to a state of a vehicle, fuel consumption and a heating performance of the vehicle can be improved, and by simplifying a configuration thereof, the number of assembly operations can be reduced.

For this purpose, the vehicle heat exchanger 100 according to an exemplary embodiment of the present invention is provided between the water pump 10 and the heater core 30 and is connected to an automatic transmission 40 through an oil line (hereinafter, referred to as an 'O.L').

That is, in the present exemplary embodiment, the each working fluid is formed with coolant that is injected from the radiator 41 and transmission oil that is injected from the automatic transmission 40, and by heat exchange between the coolant and the transmission oil through the heat exchanger 100, a temperature of the transmission oil is adjusted.

As shown in FIGS. 2 and 3, the heat exchanger 100 includes a heat releasing unit 110, a bypass unit 120, and a valve unit 130, and each constituent element will be described in detail.

First, in the heat releasing unit 110, a plurality of plates 112 are stacked to form other connection flow channels 114 to intersect at the inside thereof, and while coolant and transmission oil pass through the each connection flow channel 114, a heat is exchanged.

Here, the heat releasing unit 110 makes flow of coolant and transmission oil to counterflow and thus the coolant and the transmission oil exchange a heat.

The heat releasing unit 110 having the above-described configuration may be formed in a plate shape that is stacked with a plurality of plates 112.

In order to connect to the each connection flow channel 114, the bypass unit 120 connects one inflow hole 116 and exhaust hole 118 among a plurality of inflow holes 116 and exhaust holes 118 that are formed in the heat releasing unit 110 and bypasses a working fluid by the valve unit 130 operating according to a temperature of an injected working fluid, thereby immediately exhausting the working fluid to the exhaust hole 118.

In the present exemplary embodiment, the inflow hole 116 is formed with first and second inflow holes 116*a* and 116*b* that are each formed at both sides of one side in a length direction of the heat releasing unit 110.

The each exhaust hole 118 includes first and second exhaust holes 118*a* and 118*b* that are separated from the first and second inflow holes 116*a* and 116*b* at both sides in a length direction of the heat releasing unit 110 to correspond to the first and second inflow holes 116*a* and 116*b* and that are connected to the each connection flow channel 114 at the inside of the heat releasing unit 110.

Here, the first inflow hole 116*a* and the first exhaust hole 118*a* are formed at each corner portion in a diagonal direction at one surface of the heat releasing unit 110.

In the present exemplary embodiment, the second inflow hole 116*b* and the second exhaust hole 118*b* are formed at each corner portion in a diagonal direction at one surface of the heat releasing unit 110, and the first inflow hole 116*a* and the first exhaust hole 118*a* are formed opposite.

The bypass unit 120 connects the first inflow hole 116*a* and the first exhaust hole 118*a* and is protruded from one surface of the heat releasing unit 110.

In the present exemplary embodiment, coolant circulates through the first inflow hole 116*a* and the first exhaust hole 118*a*, and transmission oil circulates through the second inflow hole 116*b* and the second exhaust hole 118*b*.

Respective connection ports are mounted in the first and second inflow holes 116*a* and 116*b* and the first and second exhaust holes 118*a* and 1118*b* and are connected to the radiator 41 and the automatic transmission 40 through a connection hose or a connection pipe that is mounted in the connection port.

In the present exemplary embodiment, as shown in FIGS. 4 and 5, the each connection flow channel 114 includes a first connection flow channel 114*a* in which coolant is injected and moves and a second connection flow channel 114*b* in which transmission oil is injected and moves.

Here, in order to immediately exhaust coolant that is injected into the first inflow hole 116*a* to the first exhaust hole 118*a* separately from the first connection flow channel 114*a* at a position adjacent to the first inflow hole 116*a* and the first exhaust hole 118*b*, the bypass unit 120 forms a separate bypass flow channel 122.

The valve unit 130 is mounted at the inside of the heat releasing unit 110 to correspond to the first inflow hole 116*a* that forms the bypass unit 120.

The valve unit 130 is selectively opened or closed using a deformation force of bimetal that is deformed according to a temperature of a working fluid that is injected into the inside thereof and injects coolant into the heat releasing unit 110 or bypasses coolant to the bypass flow channel 122 in which the bypass unit 120 forms.

Here, as shown in FIGS. 6 and 7, the valve unit 130 includes a fixing member 132, a rod 138, a mounting cap 142, a deformation member 144, an inner case 146, and an outer case 154.

First, the fixing member 132 has a mounting groove 134 at the center of an upper surface and is fixedly mounted to the other surface of the heat releasing unit 110 to correspond to the first inflow hole 116*a*.

The fixing member 132 is screw-engaged with the heat releasing unit 110 with a screw that is formed at an exterior circumference thereof and has a tool groove that can engage with or detach from the heat releasing unit 110 using a separate tool at a lower surface thereof.

In the present exemplary embodiment, the rod 138 is rotatably mounted in a state in which the lower end thereof is inserted into the mounting groove 134 of the fixing member 132. The rod 138 is mounted in a vertically standing state toward an upper part from the fixing member 132.

The mounting cap 142 has an insertion hole 143 at the center thereof in which the rod penetrates and is mounted in an upper part of the fixing member 132.

Here, the fixing member 132 is integrally formed with a mounting portion 136 that protrudes by a predetermined portion from an upper part of an upper surface in which the mounting groove 134 is formed and in which the mounting cap 142 is mounted.

The mounting portion 136 has a screw at an exterior circumference thereof to be screw-engaged with the mounting cap 142.

That is, the mounting cap 142 is mounted in the mounting portion 136 in an upper part of the fixing member 132 in a state in which the rod 138 is inserted into the insertion hole 143 and thus performs a function of preventing the rod 138 that is inserted into the mounting groove 134 from being separated from the mounting groove 134.

In the present exemplary embodiment, the deformation member 144 is mounted in the rod 138 in an upper part of the mounting cap 142 and rotates the rod 138 in a forward direction or a backward direction while contracting and expanding according to a temperature of a working fluid.

The deformation member 144 is made of a bimetal material that contracts and expands according to a temperature of a working fluid.

Here, bimetal is formed by welding or soldering two metal plates having different heat expansion coefficients, is a material in which internal deformation is integrally performed according to rise and fall of a temperature, and has a property that expands when a temperature rises and that restores to an original shape by again constricting when a temperature falls.

The deformation member 144 that is made of such a bimetal material is formed in a spiral whirlpool shape, and one end thereof that is positioned at the center is bent to be fixed to the rod 138 in a state that penetrates a lower portion of the rod 138.

The other end of the deformation member 144 is bent to the outside of the deformation member 144 to be supported by the inside of the outer case 154.

Here, in the outer case 154, a latch protrusion 155 is protruded toward the inside in order to fix the other end of the deformation member 144 in a supported state at one side of an interior circumference to correspond to the other end of the deformation member 144.

Accordingly, when coolant of an increased temperature is injected through the first inflow hole 116*a*, while a temperature of the deformation member 144 rises, the other end of the deformation member 144 expands in a state that is supported by the latch protrusion 155 of the outer case 154, thereby rotating the rod 138 in a forward direction.

Alternatively, when coolant of a lowered temperature is injected, while the deformation member 144 is being constricted and is deformed in an initial shape, and the deformation member 144 rotates the rotated rod 138 in a backward direction, thereby recovering to an initial position.

In the present exemplary embodiment, the inner case 146 is formed in a cylindrical shape having an opened lower end portion in order to insert toward the fixing member 132 in an upper part of the rod 138, and an upper part of the inner case 146 is fixed at the front end of the rod 138 in an upper part of the fixing member 132 and rotates together with the rod 138.

At least one first bypass hole 148 is formed in an upper part of the inner case 146, and at least one first opening hole 152 that is separated from the first bypass hole 148 and that is connected to the lower end thereof is formed in a lower part thereof.

Here, the inner case 146 is fixed to the rod 138 through a fixing pin 149 that is inserted into the side of the rod 138 in an upper end portion.

Further, in order to deform the deformation member 144 by injecting a working fluid that is injected into the first inflow hole 116*a* into the valve unit 130, the inner case 146 has at least one penetration hole 151 at an upper surface thereof.

Here, the penetration hole 151 is separated by a setting angle in a circumferential direction in an upper surface of the inner case 146, and three penetration holes 151 are formed.

In the present exemplary embodiment, the first bypass hole 148 and the first opening hole 152 are separated by a setting angle along a circumference thereof in an upper part and a lower part on an external side surface of the inner case 146.

The first bypass hole 148 and the first opening hole 152 are separated by 120° along a circumference of an exterior circumference of the inner case 146, three first bypass holes 148 and three first opening holes 152 are formed, and the first opening hole 152 is formed in a length direction of the inner case 146 in a lower part that is separated from the first bypass hole 148.

The first bypass hole 148 and the first opening hole 152 exhaust coolant that is injected into the inside thereof through the penetration hole 151 to the first connection flow channel 116*a* or the bypass flow channel 122.

The outer case 154 is formed in a cylindrical shape having opened both ends and rotatably supports the inner case 146 in a state that encloses the outside of the inner case 146.

When the deformation member 144 is deformed by contraction or expansion, at least one second bypass hole 156 and second opening hole 158 that are selectively connected to the first bypass hole 148 and the first opening hole 152 are formed according to a rotation of the inner case 146 rotating together with the rod 138 and thus the lower end of the outer case 154 is fixed to an upper part of the fixing member 132.

Here, the second bypass hole 156 and the second opening hole 158 are alternately formed at a position that is separated by a setting angle along a circumference thereof in an upper part and a lower portion of the outer case 154 to correspond to the first bypass hole 148 and the first opening hole 152.

The second opening hole 158 is formed in a length direction in a lower portion of the outer case 154 at an alternate position with the second bypass hole 156.

In the present exemplary embodiment, the second bypass hole 156 is separated by 120° along a circumference of an exterior circumference in an upper part of the outer case 154, and three second bypass holes 156 are formed. The second opening hole 158 is separated by 120° along a circumference of an exterior circumference in a lower portion of the outer case 154 at an alternate position with the second bypass hole 156, and three second opening holes 158 are formed.

A sealing ring 161 is mounted between the fixing member 132 and the outer case 154 and prevents a working fluid from being leaked between the heat releasing unit 110 and the fixing member 132 while preventing coolant, which is a working fluid that is injected into the valve unit 130 from being leaked to the outside, except for the bypass holes 148 and 156 and the opening holes 152 and 158 of the valve unit 130.

That is, the seal ring 161 seals between the fixing member 132 and the outer case 154 and simultaneously seals the fixing member 132 and an interior circumference of the heat releasing unit 110 in order to prevent a working fluid from being leaked to the outside along an exterior circumference of the fixing member 132 that is engaged with the heat releasing unit 110.

When the outer case 154 is mounted in the fixing member 132, the second bypass hole 156 is positioned at a position corresponding to the first bypass hole 148 to be connected to the inside of the inner case 146.

Accordingly, the second opening hole 158 is positioned between the first opening hole 152 to maintain a state that is closed by the inner case 146.

Figure 8:
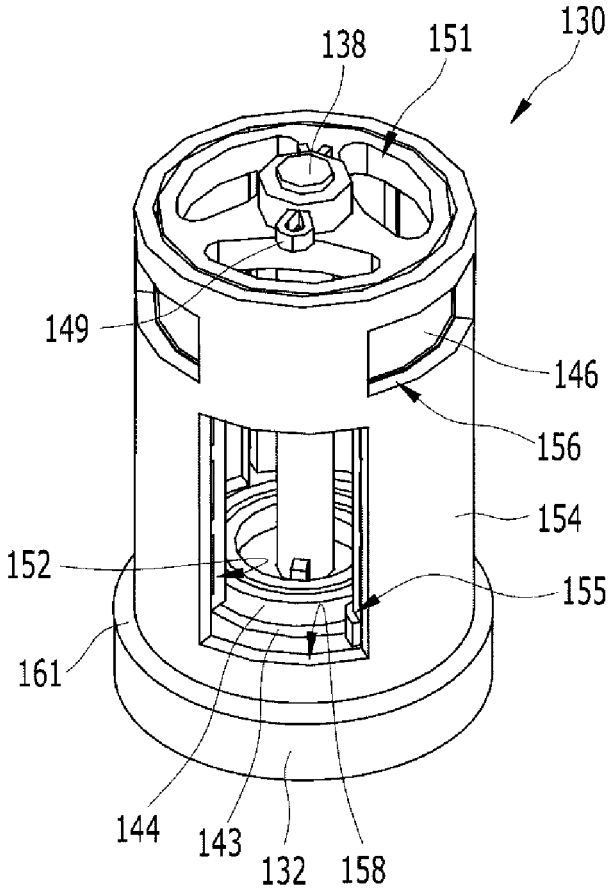
FIG. 8 is a perspective view illustrating an operation state of a valve unit according to an exemplary embodiment of the present invention.

In the valve unit 130 having the above-described configuration, when a working fluid having a setting temperature is injected through the first inflow hole 116*a*, as shown in FIG. 8, the working fluid is injected into the valve unit 130 through each penetration hole 151, and thus the deformation member 144 expands and is deformed.

Accordingly, while the deformation member 144 expands and is deformed in a state in which the other end thereof is supported by the latch protrusion 155 by a working fluid having a setting temperature, one end of the deformation member 144 rotates and rotates the rod 138, and in this case, the inner case 146 that is connected to the rod 138 rotates together.

Thereafter, as the each first bypass hole 148 rotates to a closed position between the each second bypass hole 156, the first and second bypass holes 148 and 156 are positioned at each closed portion of the inner case 146 and the outer case 154, respectively, the first and second bypass holes 148 and 156 are in a closed state, and the first opening hole 152 is positioned at the second opening hole 158 and maintains an open state.

Accordingly, when coolant having a setting temperature is injected into the valve unit 130, the valve unit 130 closes the first and second bypass holes 148 and 156 and injects the coolant to the first connection flow channel 114*a* through the opened first and second opening holes 152 and 158 in a state that prevents the coolant from being injected into the bypass flow channel 122.

Alternatively, when a working fluid of a temperature lower than a setting temperature is injected into the first inflow hole 116*a*, while the deformation member 144 contracts and is deformed in an initial state, as shown in FIG. 6, the deformation member 144 rotates the inner case 146 in a backward direction and thus closes the first and second opening holes 152 and 158, whereby the first bypass hole 148 is positioned at the second bypass hole 156 and maintains an open state.

Hereinafter, operation of the vehicle heat exchanger 100 having the above-described configuration according to an exemplary embodiment of the present invention will be described in detail.

Figure 9:
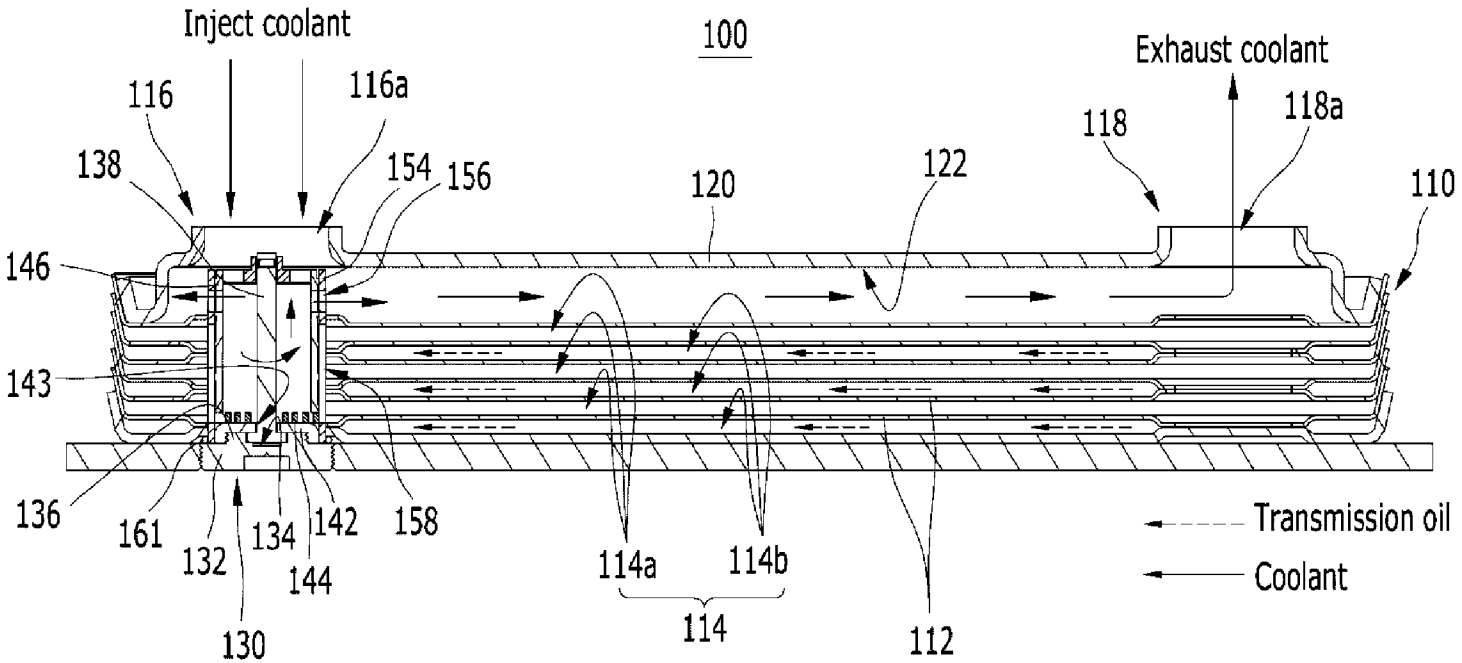
FIGS. 9 and 10 are views illustrating an operation state at each step of a heat exchanger for a vehicle according to an exemplary embodiment of the present invention.
Figure 10:
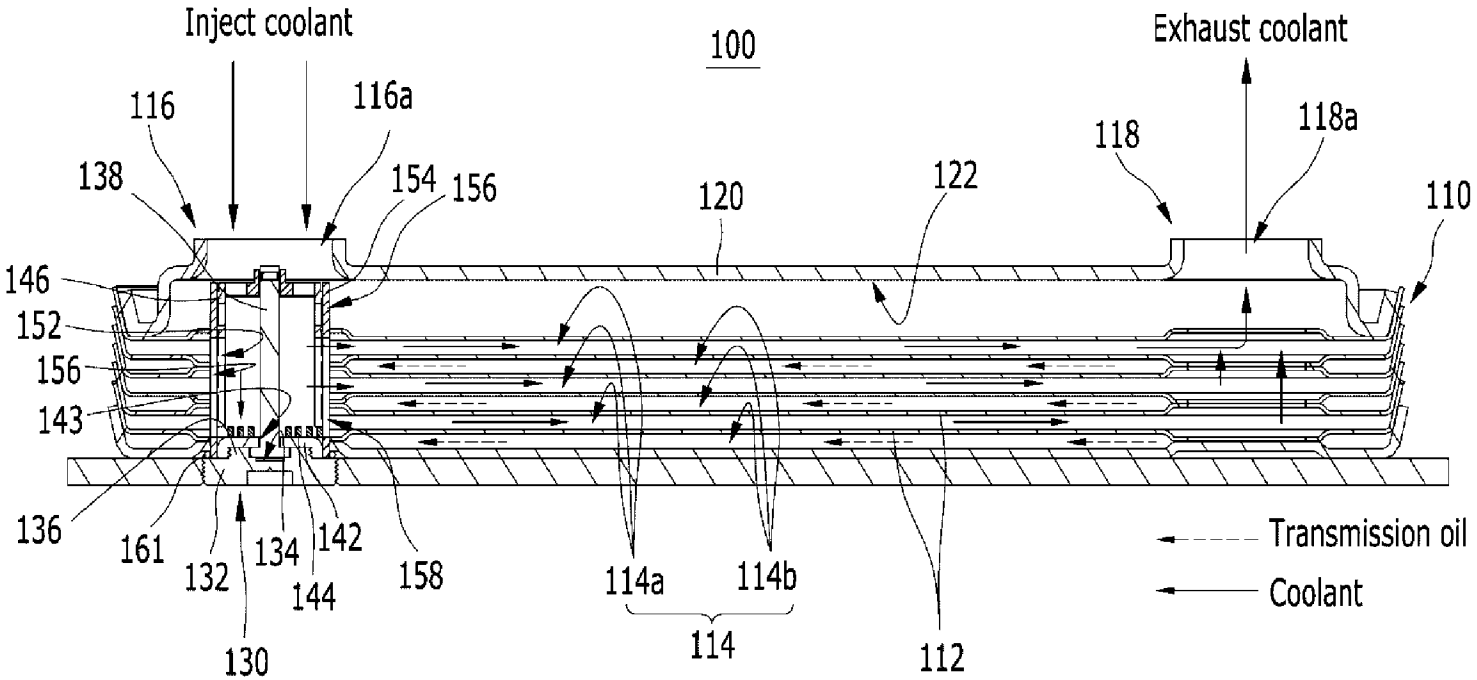

FIGS. 9 and 10 are perspective views illustrating an operation state at each step of a heat exchanger for a vehicle according to an exemplary embodiment of the present invention.

First, when coolant is injected through the first inflow hole 116*a*, if a water temperature of the coolant is lower than a setting water temperature, as shown in FIG. 9, because a water temperature of the coolant that is injected from the valve unit 130 to the penetration hole 151 is lower than a deformation start temperature, the deformation member 144 is not deformed and maintains an initial state.

Therefore, as the rod 138 does not rotate, the inner case 146 maintains an initial mounting state (see FIG. 6) in which the first bypass hole 148 is positioned at the same position as that of the second bypass hole 156 of the outer case 154.

In this case, as described above, as the first opening hole 152 and the second opening hole 158 are positioned at respective closed portions of the inner case 146 and the outer case 154, the first opening hole 152 and the second opening hole 158 maintain a closed state without opening.

Therefore, the injected coolant is exhausted from the valve unit 130 through the first and second bypass holes 148 and 156 of an open state, is not injected into the first connection flow channel 116*a* of the heat releasing unit 110, flows through the bypass flow channel 122 in which the bypass unit 120 is formed, immediately bypassed to the first exhaust hole 118*a*, and is exhausted.

Accordingly, the coolant is prevented from injecting into the first connection flow channel 114*a* of the heat releasing unit 110 and is injected through the second inflow hole 116*b*, and thus it is prevented that the coolant exchanges a heat with transmission oil that passes through the second connection flow channel 114*b* of the heat releasing unit 110.

That is, when warm-up of transmission oil is necessary according to a state or a mode of a vehicle like a running state, an idle mode, or initial starting of the vehicle, the bypass flow channel 122 bypasses coolant of a low temperature state to prevent from being injected into the first connection flow channel 114*a*, thereby preventing a temperature of the transmission oil from being lowered through heat exchange between the transmission oil and the coolant.

Alternatively, if a water temperature of coolant is higher than a setting water temperature, as shown in FIG. 10, the deformation member 144 of the valve unit 130 expands in a state in which the other end thereof is supported by the latch protrusion 155 of the outer case 154 by coolant that is injected into the penetration hole 151 and rotates the rod 138 in a forward direction.

Accordingly, as the inner case 146 rotates together with the rod 138, the first bypass hole 148 performs a rotation movement to a closed portion between the second bypass hole 156 of the outer case 154 and thus the first bypass hole 148 and the second bypass hole 156 maintain a closed state (see FIG. 8).

In this case, as the first opening hole 152 rotates by the inner case 146 to be positioned at the same position as that of the second opening hole 158, the first and second opening holes 152 and 158 are opened.

Therefore, in a state that coolant that is injected into the valve unit 130 is prevented from injecting into the bypass flow channel 122 by the closed first and second bypass holes 148 and 156, the coolant is exhausted through the opened first and second opening holes 152 and 158, is injected into the first connection flow channel 114*a*, and is exhausted through the first exhaust hole 118*a*.

A portion of coolant that is injected into the first inflow hole 116*a* flows through the bypass flow channel 122 in a state that does not pass through the valve unit 130 and is exhausted through the first exhaust hole 118*a* together with coolant, having passed through the first connection flow channel 114*a*.

Accordingly, the coolant passes through the first connection flow channel 114*a* of the heat releasing unit 110, and transmission oil that is injected through the second inflow hole 116*b* and that passes through the second connection flow channel 114*b* exchanges a heat with the coolant that passes through the first connection flow channel 114*a* within the heat releasing unit 110 and thus a temperature of the transmission oil is adjusted.

Here, as the first and second inflow holes 116*a* and 116*b* are formed in a corner portion in a diagonal direction of the heat releasing unit 110, the coolant and the transmission oil make flow to counterflow and exchange a heat, thereby performing more efficient heat exchange.

Accordingly, as transmission oil is heated due to a fluid friction occurring by operation of a torque converter, transmission oil in which cooling is necessary is supplied to the automatic transmission 40 in a cooled state through heat exchange with the coolant in the heat releasing unit 110.

That is, as the heat exchanger 100 supplies cooled transmission oil to the automatic transmission 40 rotating in a high speed, slip of the automatic transmission 40 is prevented from occurring.

In this way, in the vehicle heat exchanger 100 according to an exemplary embodiment of the present invention, while the deformation member 144 of the valve unit 130 is contracted or expanded according to a water temperature of injected coolant, the deformation member 144 rotates the rod 138 in a forward direction or a backward direction, together rotates the inner case 146 that is connected to the rod 138, and thus coolant that is injected into the inside is exhausted through the first and second bypass holes 148 and 156, or the first and second opening holes 152 and 158, and thus flow of the coolant that passes through the heat exchanger 100 is adjusted.

Therefore, when the vehicle heat exchanger 100 having the above-described configuration according to an exemplary embodiment of the present invention is applied, if a working fluid adjusts a temperature through heat exchange at the inside, a warm-up function and a cooling function of the working fluid are simultaneously performed using a temperature of the injected working fluid according to a running state or an initial starting condition of the vehicle, and thus temperature adjustment of the working fluid can be efficiently performed.

Further, because a conventionally separately installed branch circuit can be removed, a production cost can be reduced and workability can be improved, and when a working fluid is transmission oil of the automatic transmission 40, a warm-up function for friction reduction at cold starting and a cooling function for slip prevention and durability maintenance upon starting can be simultaneously performed and thus fuel consumption and durability of a transmission can be improved.

Further, because a temperature of a working fluid can be adjusted according to a state of the vehicle, fuel consumption and a heating performance of the vehicle can be improved, and by simplifying a configuration, the number of assembly operations can be reduced.

Further, by selectively flowing the working fluid to the heat releasing unit 110 and the bypass unit 120 according to a temperature of a working fluid that is injected through the valve unit 130 to which the deformation member 144 of a bimetal material is applied, flow of the working fluid can be accurately controlled, and by simplifying a constituent element, compared with a conventional wax expansion type valve, a production cost can be reduced and a weight can simultaneously be reduced.

Responsiveness of a valve switch operation according to a temperature of the working fluid can be improved.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A heat exchanger apparatus for a vehicle, comprising:

a heat releasing unit that is stacked with plates and that has first and second connection flow channels at the inside thereof to inject working fluids and that exchanges a heat of the working fluids that pass through the first and second connection flow channels;

a bypass unit that connects an inflow hole and an exhaust hole that are formed in the heat releasing unit, wherein the inflow hole and the exhaust hole are connected to the first and second connection flow channels, respectively and wherein the bypass unit selectively bypasses an injected working fluid therethrough;

a valve unit that is selectively open or closed using a deformation member that is deformed according to a temperature of a working fluid that is injected into the inside thereof to inject the working fluid into the heat releasing unit and the bypass unit;

wherein the inflow hole includes first and second inflow holes that are each formed at both sides thereof in a length direction of the heat releasing unit; and wherein the exhaust hole is separated from the first and second inflow holes at both sides, in a length direction of the heat releasing unit and include first and second exhaust holes that are connected to respective connection flow channel at the inside of the heat releasing unit;

wherein the valve unit includes;

a deformation member deformable according to a temperature of the working fluid;

an inner case having a first bypass hole and a first opening hole; and an outer case enclosing the inner case and rotatably supporting the inner case, wherein the outer case includes a second bypass hole and a second opening hole that are selectively fluid-connected to the first bypass hole and the first opening hole according to the inner case rotated by the deformation member; and a fixing member that has a mounting groove at the center of an upper surface and that is fixedly mounted in the heat releasing unit to correspond to the first inflow hole;

a rod having a lower end portion that is inserted into the mounting groove of the fixing member and that is rotatably mounted thereto;

a mounting cap having an insertion hole at the center in order to receive the rod therethrough and that is mounted in the fixing member;

the deformation member that is mounted in the rod in an upper part of the mounting cap and that rotates the rod in a forward direction or a backward direction according to the temperature of the working fluid;

the inner case that is fixed to a front end of the rod in an upper part of the fixing member to rotate together with the rod and that has the first bypass hole in the upper part, and that has the first opening hole that is separated from the first bypass hole; and the outer case that rotatably supports the inner case in a state that encloses the outside of the inner case and that has the second bypass hole and the second opening hole that are selectively connected to the first bypass hole and the first opening hole according to the rotation of the inner case and that is fixed to the fixing member; and wherein the deformation member is made of a bimetal material that contracts and expands according to the temperature of the working fluid.

2. The heat exchanger apparatus of claim 1, wherein the deformation member is formed in a spiral whirlpool shape, and one end that is positioned at the center thereof is bent to be fixed to the rod in a state that penetrates through a lower portion of the rod, and the other end thereof is bent to the outside of the deformation member to be supported by the inside of the outer case.

3. The heat exchanger apparatus of claim 2, wherein in the outer case, a latch protrusion is protruded toward the inside thereof so that the other end of the deformation member is fixed in a state that is supported at one side of an interior circumference to correspond to the other end of the deformation member.

4. The heat exchanger apparatus of claim 1, wherein the inner case is fixed to the rod through a fixing pin that is inserted into the side of the rod in an upper end portion.

5. The heat exchanger apparatus of claim 1, wherein the inner case has a penetration hole at an upper surface thereof in order to inject a working fluid that is injected into the first inflow hole into the valve unit.

6. The heat exchanger apparatus of claim 5, wherein a plurality of penetration holes are separated by a setting angle in a circumferential direction at an upper surface of the inner case, and three penetration holes are formed.

7. The heat exchanger apparatus of claim 1, wherein the inner case is formed in a cylindrical shape having an opened lower end portion.

8. The heat exchanger apparatus of claim 1, wherein the first bypass hole and the first opening hole are separated by a setting angle along a circumference thereof in an upper part and a lower part of the inner case.

9. The heat exchanger apparatus of claim 1, wherein the first opening hole is formed in a length direction of the inner case in a lower part that separated from the first bypass hole.

10. The heat exchanger apparatus of claim 1, wherein the second bypass hole and the second opening hole are alternately formed at a position that is separated by a setting angle along a circumference thereof in an upper part and a lower part of the outer case to correspond to the first bypass hole and the first opening hole respectively.

11. The heat exchanger apparatus of claim 1, wherein the second opening hole is formed in a length direction in a lower part of the outer case at a position alternately with the second bypass hole.

12. The heat exchanger apparatus of claim 1, wherein the fixing member is integrally formed with a mounting portion that is protruded by a predetermined portion from an upper portion of an upper surface in which the mounting groove is formed and in which the mounting cap is mounted.

13. The heat exchanger apparatus of claim 1, wherein a seal ring that prevents a working fluid from being leaked between the heat releasing unit and the fixing member while preventing a working fluid that is injected into the valve unit from being leaked to the outside of the valve unit is mounted between the fixing member and the outer case.

14. The heat exchanger apparatus of claim 1, wherein the outer case is formed in a cylindrical shape having opened both ends.

15. The heat exchanger apparatus of claim 1, wherein the bypass unit connects the first inflow hole and the first exhaust hole and is protruded from one side of the heat releasing unit.

16. The heat exchanger apparatus of claim 1, wherein the each working fluid is formed with coolant that is injected from a radiator and transmission oil that is injected from an automatic transmission, the coolant circulates through the first inflow hole and the first exhaust hole, and the transmission oil circulates through the second inflow hole and the second exhaust hole, and the each connection flow channel includes a first connection flow channel in which the coolant is injected and moves and a second connection flow channel in which the transmission oil is injected and moves.

17. The heat exchanger apparatus of claim 1, wherein the bypass unit has a separate bypass flow channel separately from the first connection flow channel in order to immediately exhaust coolant that is injected into the first inflow hole to the first exhaust hole through the valve unit at a position adjacent to the first inflow hole and the first exhaust hole.

* * * * *